US006364620B1

(12) United States Patent
Fletcher et al.

(10) Patent No.: US 6,364,620 B1
(45) Date of Patent: Apr. 2, 2002

(54) SUBMERSIBLE PUMP CONTAINING TWO LEVELS OF MOISTURE SENSORS

(75) Inventors: Jason Fletcher; John Zoeller, both of Louisville, KY (US)

(73) Assignee: Zoeller Company, Louisville, KY (US)

( * ) Notice: Subject to any disclaimer, the term of this patent is extended or adjusted under 35 U.S.C. 154(b) by 0 days.

(21) Appl. No.: 09/650,184

(22) Filed: Aug. 29, 2000

(51) Int. Cl.[7] ..... F04B 49/00
(52) U.S. Cl. ..... 417/36; 340/854.8
(58) Field of Search ..... 417/36, 18, 40, 417/38; 340/854.8, 618; 37/311, 309

(56) References Cited

U.S. PATENT DOCUMENTS

| | | | | | |
|---|---|---|---|---|---|
| 4,253,255 | A | * | 3/1981 | Durell | 37/311 |
| 4,353,174 | A | * | 10/1982 | Maloblocki | 37/309 |
| 4,396,353 | A | * | 8/1983 | McDonald | 417/36 |
| 5,173,019 | A | | 12/1992 | Sdano | |
| 5,234,319 | A | * | 8/1993 | Wilder | 417/40 |
| 5,238,369 | A | * | 8/1993 | Farr | 417/18 |
| 5,447,078 | A | | 9/1995 | Robinson, Jr. et al. | |
| 5,466,127 | A | * | 11/1995 | Arnswald | 417/38 |
| 5,521,592 | A | * | 5/1996 | Veneruso | 340/854.8 |
| 5,856,783 | A | * | 1/1999 | Gibb | 340/618 |

FOREIGN PATENT DOCUMENTS

| | | | | |
|---|---|---|---|---|
| DE | 2411833 | * | 10/1974 | C02B/9/02 |
| FR | 2584459 | * | 1/1987 | F04D/15/02 |
| FR | 1035328 | * | 12/2000 | F04D/13/08 |

* cited by examiner

*Primary Examiner*—Teresa Walberg
*Assistant Examiner*—L Fastowsky
(74) *Attorney, Agent, or Firm*—Scott R. Cox

(57) ABSTRACT

A dual moisture alarm system for use in submersible pumps, including a pump housing, a motor for running the pump which includes a shaft attached to an impeller. Secured to and located within the pump housing are a series of power control and sensing cords. Attached to these cords are both a lower liquid sensing probe and an upper liquid sensing probe which can sense the presence of fluids, both in a lower sealing chamber located below the motor and an upper chamber located above the motor. The upper liquid sensing probe senses the presence of fluids within the upper chamber before the power terminals also located in the upper chamber are contacted by the fluids.

6 Claims, 4 Drawing Sheets

SUBMERSIBLE PUMP CONTAINING TWO LEVELS OF MOISTURE SENSORS

CROSS REFERENCE TO RELATED APPLICATIONS

NONE

BACKGROUND ON THE INVENTION

1. Field of Invention

The field of art to which this invention pertains is waste water systems. More specifically, this invention relates to a waste water pumping system containing a pair of moisture sensors within said pump system with one sensor located at a lower level and one sensor located at an upper level within the pumping system.

2. Description of Related Art

Submersible pumps are often utilized in the basements of homes, commercial buildings, etc. and are designed to discharge from those buildings water or other fluids that accumulate in the sump, as happens, for example, during a storm. When fluids collect in the sump and rise to a particular level, the pump is designed to pump those liquids out of the sump. Serious monetary losses can occur if the fluids are not removed.

These pumps always operate in a wet environment and are frequently positioned within the sump where water or other fluids can accumulate. Because these pumps generally use electrical motors, it is important to the continued operation of these pumps that moisture or water does not leak into the internal workings of the pump. Such leakage into the pump could damage the operation of the pump.

One type of pump available at present includes an impeller casing having a fluid inlet and a fluid outlet with an impeller located within the casing for moving the fluid through and out the casing. The impeller is mounted on and rotated by a shaft which is driven by a motor. In modular design, this motor is located external to the impeller casing and a shaft passes from the motor through the impeller casing. The shaft and impeller are supported by bearings which are located within a housing filled with oil which also provides lubrication of the bearings and seals. Because the motor is located away from the fluid to be pumped, this type of motor is less susceptible to damage from leakage into the housing by fluids in a sump.

Another type of pump commonly used in sumps is a submersible pump. These submersible pumps are generally comprised of a pump housing which contains a motor, a shaft directed from the motor, an impeller for evacuating the fluid from within the sump, power control and sensing cords to operate the pump motor. These submersible pumps conventionally include one or more seals, particularly around the shaft. These seals are designed to prevent liquids being pumped by the submersible pump from entering the housing.

Because these submersible pumps are designed for the discharge of liquids, sewage and/or effluent, there is always the possibility that the liquids will seep around the seals and enter the inner workings of the pump. This has been a particular problem in the lower portion of the pump as it is most likely to be emersed in fluids. In addition, the lower portion of the submersible pump also contains numerous pathways in the housing that are susceptible to leaks. If the leaks become excessive, they can short out the motor, resulting not only in damage to the motor but potential damage to the building, sometimes resulting in serious monetary losses.

To the end of insuring reliable submersible pump operation, it has become conventional to include in the lower portion of these submersible pumps some form of liquid sensing probe. Many of the common submersible pump motors include such moisture sensing probes, such as motors produced by Paco®, Weil, Flygt, Hydromatic™, and Myers pumps. In each of these systems a liquid sensing probe extends downward into a conventional oil chamber located above the impeller near the bottom of the motor housing. This oil chamber is designed to lubricate the seals of the shaft as well as cool the shaft while it is rotating.

However, because of the tolerances that are necessary between the shaft impeller and the housing, leaks of liquids are possible around this shaft, which may result in liquids entering the oil chamber. These liquid sensing probes sense the presence of liquids and send a warning of the presence of liquids in this oil chamber. Once this warning is sent, the motor can then be removed for repair or replacement or other actions can be taken to address the potential problem of leakage.

A submersible pump including a secondary containment area with an alarm system is disclosed in U.S. Pat. No. 5,173,019. In this system, a pump assembly including an impeller mounted on a shaft includes a liquid sensor switch (70). This liquid sensor is located within a secondary containment vessel (54) to sense the presence of liquids within this section of the pump housing as shown in FIG. 4.

A pair of moisture sensing probes (52) are disclosed within a moisture barrier sump chamber (38) in U.S. Pat. No. 5,447,078. This patent discloses a submersible gear motor which includes a motor housing (24) and a gear train housing (26), which is attached to an impeller for the movement of fluids.

While the use of liquid sensing probes in conventional submersible pumps to detect the presence of water in a lower chamber of these submersible pumps has become conventional, the housing for these submersible pumps is still susceptible to leakage at other locations, particularly in the upper portion of the submersible pump, especially above the motor itself. Leakage within this section of the pump housing can also result in damage to the motor of the pump, and if left unattended, the motor can short out resulting in substantial damage to the building or home in which the pump is located. Further, such leakage may also create an electrically hazardous situation in the sump.

Accordingly, it is an object of the invention to provide a submersible pump apparatus which is easy to operate and which senses moisture which has leaked into a motor housing of the pump.

It is a further object of this invention to provide a submersible pump apparatus containing a conventional motor and impeller which contains a sensor for sensing the presence of water, both at a lower level below the motor and at an upper level with the motor.

It is a still further object of the invention to provide a submersible pump apparatus containing a pair of liquid sensing probes, one located near the bottom of the submersible pump and one located near the top of the submersible pump, which sense the presence of water before that water can damage the operation of the pump.

These and other objects and features of the present invention will be apparent to those skilled in the art from a consideration of the following detailed description, drawings and claims. The description, along with the accompanying drawings, provides a selected example of construction of the device to illustrate the invention.

SUMMARY OF THE INVENTION

In accordance with the present invention there is provided a submersible pump utilized in a sump in a commercial or residential building or in a municipal pumping station. The submersible pump includes a housing, a motor contained within the housing containing a shaft, an impeller secured to a shaft of the motor, power control and sensing cords which among other things conduct electricity to the motor to allow its operation, a lower moisture sensing probe to sense the presence of water within the housing below the motor near the bottom of the sump pump and an upper moisture sensing probe for sensing the presence of moisture within the housing at the level of the motor before the motor can be shorted out by the moisture.

BREIF DESCRIPTION OF THE DRAWINGS

The invention will now be described with reference to the accompanying drawings in which.

DETAILED DESCRIPTION OF THE INVENTION

Figure 1:
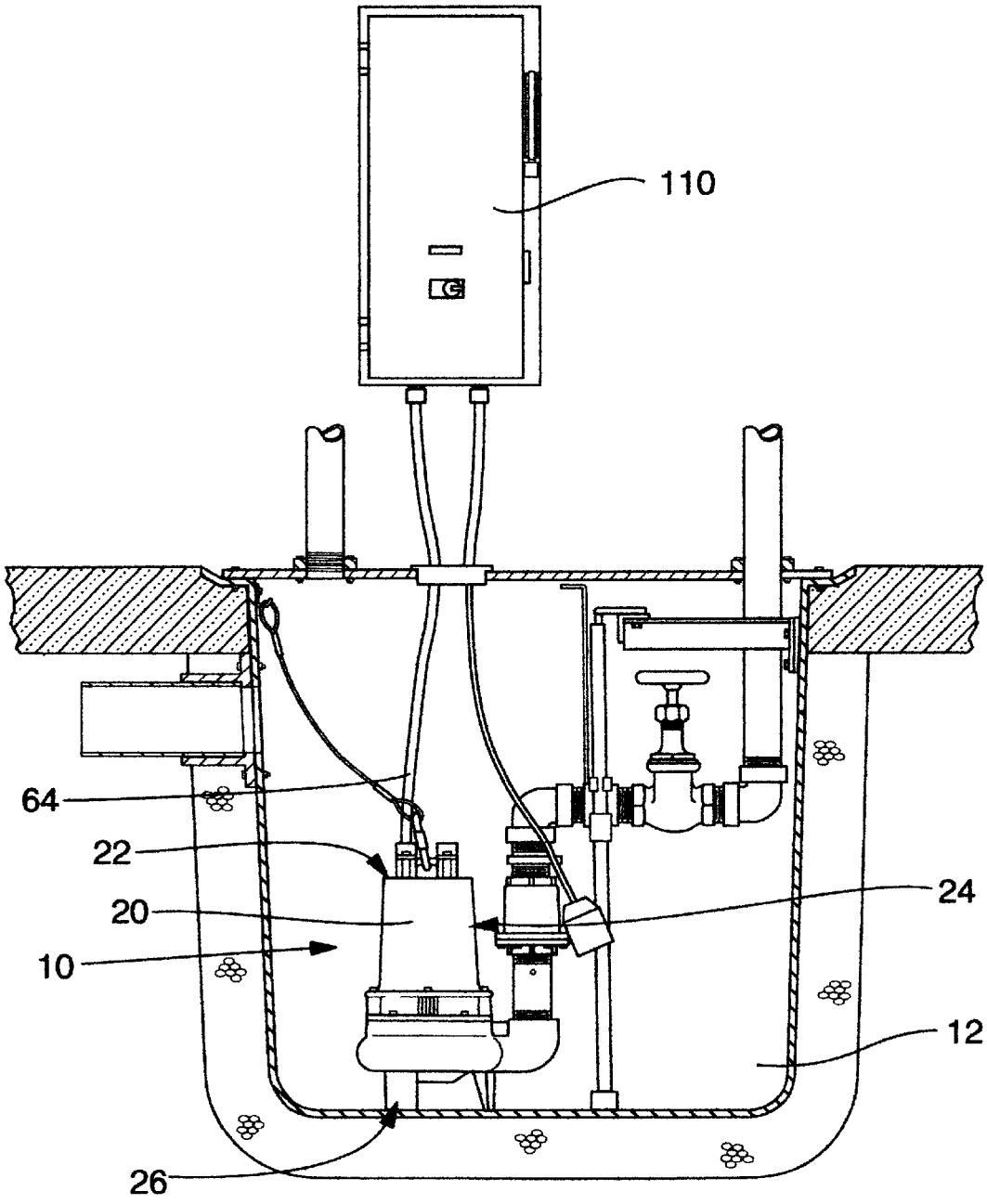
FIG. 1 is a side view of a submersible pump present in a sump.
Figure 2:
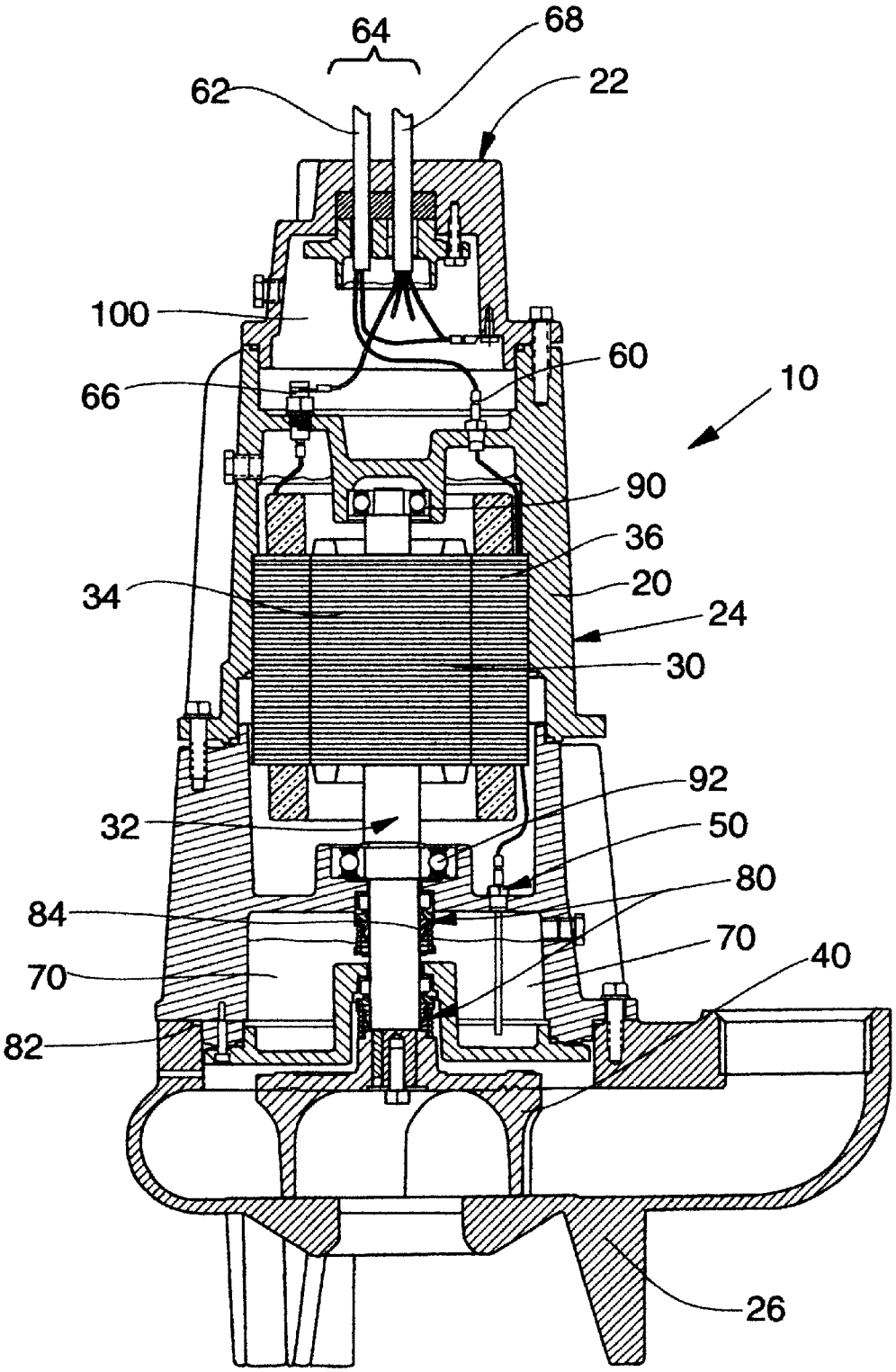
FIG. 2 is a cutaway side view of the submersible pump of FIG. 1.

Although the invention is adaptable to a wide variety of uses, it is shown in the drawings for purpose of illustration as embodied in FIGS. 1 and 2 as a submersible pump (10) used within a sump (12). The present invention is primarily directed to improvements in the structure of the mechanical components of the submersible pump (10) to the end of creating an apparatus which is more reliable, less likely to be subject to mechanical damage, and which can be easily monitored for malfunction.

Referring to FIG. 1, the submersible pump (10) is used to remove liquids, generally water, effluent, sewage or other such liquids from locations in a building. The submersible pump (10) is placed within a sump (12) for operation.

The components of the submersible pump (10) as shown in FIGS. 1 and 2 include the motor housing (20). The motor housing (20) must be liquid-tight to be submersible in liquids and includes a top (22), through which the power control and sensor cords (64) are introduced into the motor housing (20), sides (24) and a bottom (26), through which the impeller (40) is secured. The motor housing (20) is preferably constructed from a suitable material that does not substantially corrode under normal operating conditions, particularly operating conditions in a wet environment. In particular, the material should be corrosion resistant to the liquid medium in which it is going to be submerged, generally water. For most operations, the motor housing (20) can be made of cast iron. Of course, any number of other materials can also be used for the manufacture of the motor housing (20) including steel and other such materials. Preferably, the housing (20) is coated with a corrosion resistant coating.

As shown in FIG. 2, the submersible pump (10) includes the pump housing (20), a motor (30) secured within the pump housing (20), a shaft (32) secured to, and rotated by, the motor, the impeller (40) secured to the lower end of the shaft (32) and operated by the motor (30), a lower moisture sensing probe (50) located below the motor (30) and an upper moisture sensing probe (60) located above the motor (30), each of which sensors are secured to electrical sensing cords (62). The electrical sensing cords (62) operate in conjunction with the power control cords (68), which are attached to the motor (30), and the moisture sensing probes (50, 60) through the pump housing (20) for connection to a control box (110) as shown in FIG. 1. These cords (64) operate both the motor (30) of the sump pump (10) and also provide an alarm if moisture is sensed within the submersible pump (10).

Located within the housing (20) is the motor (30) as shown in FIG. 2. Conventional submersible pump motors (30) include a rotor (34) and a stator (36) mechanism to which is attached the pump shaft (32). The shaft (32) extends downward within the housing (20) where it is attached to the impeller (40). The impeller (40) may also include a grinder mechanism (not shown) for pumping and/or grinding the liquids that are pumped by the submersible pump (10). The shaft (32) of the motor (30) extends downward from the motor (30) into a sealing chamber (70) located within the lower portion of the pump housing (20). This sealing chamber (70) preferably contains a lubricating material, such as a natural or synthetic oil. This oil helps lubricate and cool the shaft (32) within the submersible pump (10) when it rotates.

Figure 3:
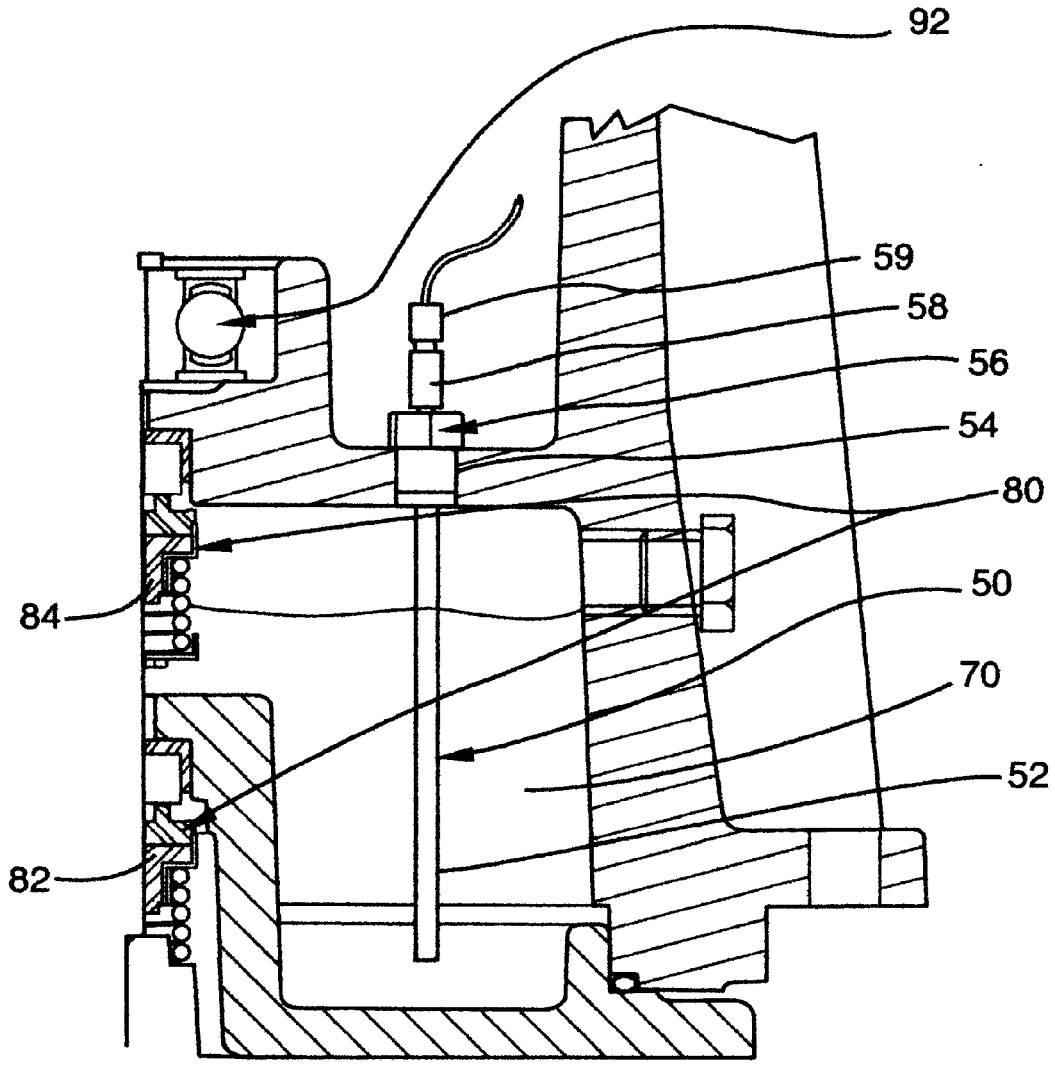
FIG. 3 is a cutaway side view of a lower portion of the submersible pump of FIG. 1.

In order to protect the motor (30) and shaft (32) from intrusion of liquids within the motor housing (20), a series of shaft seals (80) are provided as shown in FIG. 3. These shaft seals (80) seal off the housing (20) from liquids located outside of the housing (20) and are designed to prevent those liquids from leaking into the inside of the housing (20), for example, into the sealing chamber (70). In one preferred embodiment, the seals (80) comprise a lower shaft seal (82) and an upper shaft seal (84) located in or near the sealing chamber (70).

There is also located within the motor housing (20) one or more bearings (90 and 92) which assist in the rotation of the shaft (32) within the pump housing (20) as shown in FIGS. 2 and 3. For example, in one preferred embodiment a lower bearing (92) is located just above the sealing chamber (70) which surrounds the shaft (32) as shown in FIG. 3.

As is apparent from FIG. 2, there are several locations where the pump housing (20) is susceptible to leaks of liquids from outside of the pump housing (20). In addition, because the pump housing (20) is made from a series of parts which are bolted together, liquids may pass between these parts into the sealing chamber (70). Thus, liquids can leak into the sealing chamber (70) and displace oil that is normally present in the sealing chamber (70). To sense the presence of these liquids within this sealing chamber (70), many submersible pumps include a lower moisture sensing probe (50), such as is shown in FIGS. 2 and 3. This probe (50) senses the presence of moisture in this sealing chamber (70), sending a signal through the power control and sensing cords (64) out of the top (22) of the pump housing (20) which activates an alarm (not shown). This alarm advises the user of the pump (10) that a leak exists within the pump housing (20). Before significant damage occurs to the building, the pump (10) can be removed and repaired.

This lower moisture sensing probe (50) is conventional, such as is sold by Warrick Controls, Inc., and consists of an electrode (52), a sleeve (54), a cap (56) and an attachment element (58) for securing the top (59) of the lower moisture sensing probe (50) to the power control and sensing cords (64) as shown in FIG. 3.

Figure 4:
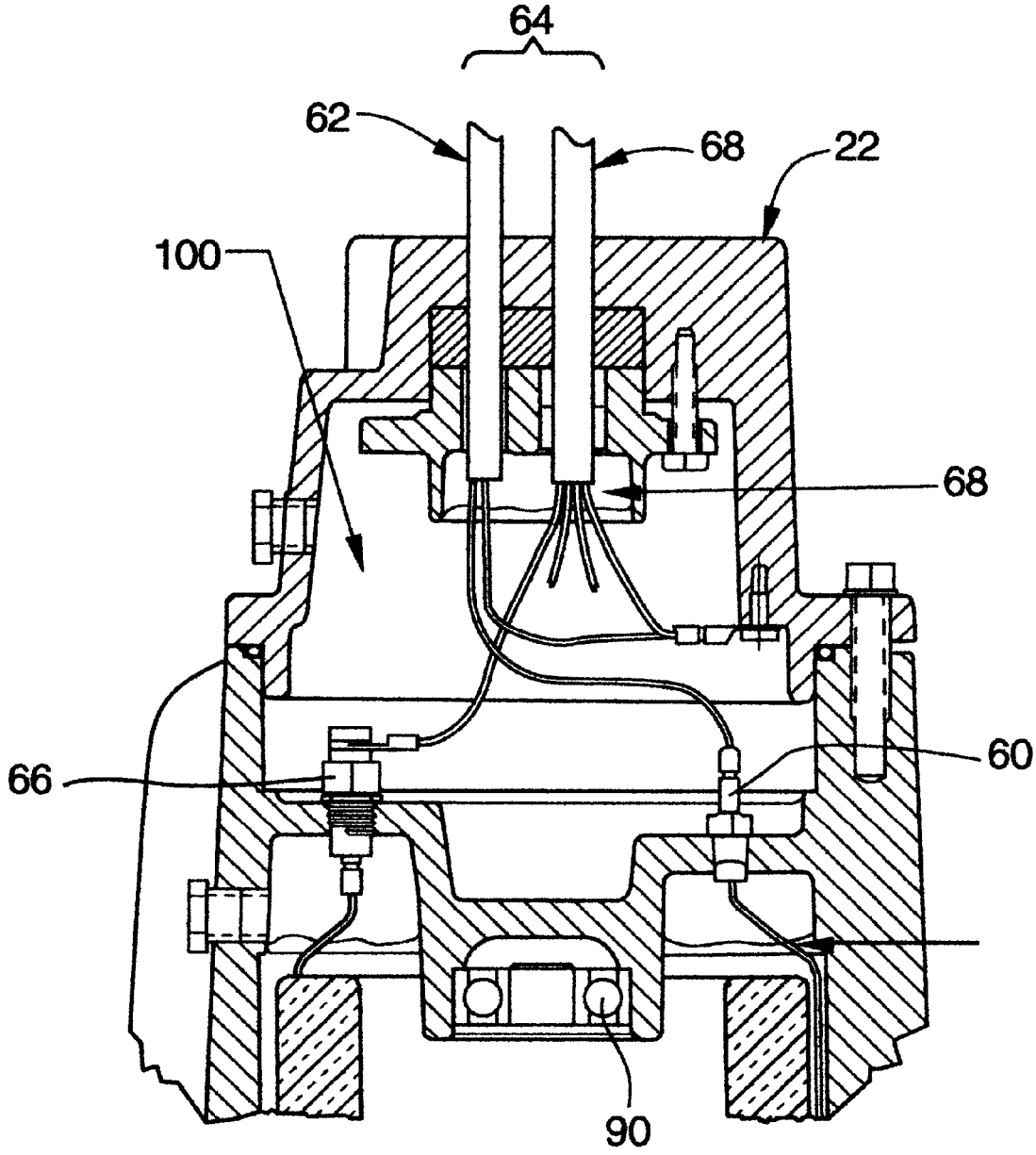
FIG. 4 is a cutaway side view of an upper portion of the submersible pump of FIG. 1 showing an upper liquid sensing probe.

Leakage into the pump can occur not only in the lower portion of the housing (20), but also in the upper portion of the housing (20). In addition, liquids entering the lower portion of the housing (20) may pass upward within the housing (20) and contact the power cords (64) located above the motor (30). The present invention provides a second or upper liquid sensing probe (60) as shown in FIGS. 2 and 4, which senses the presence of liquids within the pump housing (20) of the sump pump (10) at a location above the motor (30). Preferably, this sensing probe (60) is located at a location which is lower in the upper junction chamber (100) than is the terminal (66) for the upper power cord (68) Thus, this upper sensing probe (60) can send an alarm at a time prior to the liquids located within the pump housing (20) shorting out the motor (30) by contacting the upper power terminal (66).

In a preferred embodiment as shown in FIG. 4, the upper liquid sensing probe (60) is secured within the pump housing (20) at a position where the sensing portion of the liquid sensing probe (60) is at least about ⅜ inch lower than the power terminals (66). While a single sensing probe (60) is preferred, a pair of these upper liquid sensing probes (not shown) may also be secured within the pump housing (20) at a position at least about ⅜ inch below the power terminals (66). The upper liquid sensing probe (60) may be the same type of liquid sensing probe as is used for the lower moisture sensing probe (50) or it can be of a different design. The upper sensing probe (60) is secured to an electrical sensing cord (62) which sends a signal to a sensing alarm (not shown) located outside of the pump housing (20) which can be monitored by the owner of the submersible pump (10).

The upper liquid sensing probe (60) can be located at any location above the motor (30) and can be secured in position within the pump housing (20) by any conventional securing mechanism as long as the upper moisture sensing probe (60) is at least about ⅜ inch below the power terminals (66), as shown in FIG. 4.

The power terminals (66) are conventional and are secured within the pump housing (20) by a conventional securing mechanism such as by screwing or welding them in place within the pump housing (20). By placing the upper liquid sensing probe (60) at a position at least about ⅜ inch below the power terminals (66), the power terminals are not immediately shorted out by the presence of liquids in the upper chamber (100). Once the sensing probe (60) sends its signal, a sensing light or sensing alarm (not shown) can be activated resulting in the entire pump assembly being removed for repair and/or replacement before significant damage occurs. Without this upper sensing probe (60), moisture can enter the upper chamber (100) and short out the power terminal (66) resulting in the inability of the motor (30) to function.

Although liquids conventionally enter the lower portion of the pump housing (20) and the sealing chamber (70) first, under some circumstances those liquids can enter the upper chamber (100) prior to a sufficient quantity of liquid being present in the sealing chamber (70) to activate the lower moisture sensing probes (50). Thus, the submersible pump (10) of the present invention can signal the presence of liquids in its upper portion prior to the lower moisture sensing probe (50) being activated. The submersible pump (10) can then be checked and fixed before significant damage can occur.

In operation, the submersible pump (10) includes the motor housing (20) enclosing the motor (30), shaft (32), impeller (40) and various power control and sensing cords (64). Preferably the motor housing (20) also contains both a lower moisture sensing probe (50) and an upper moisture sensing probe (60). The lower moisture sensing probe (50) is located within the sealing chamber (70) which conventionally holds lubricating oil for the shaft (32) and is located below the motor (30). Any liquids that enter this chamber (70) and encounter the lower moisture sensing probe (50) cause an alarm to be sent to notify of a leakage problem with the sump pump (10). In addition, because of the presence of the upper moisture sensing probe (60), any liquids present in the upper chamber (100) of the pump housing (20) can also be detected prior to those liquids shorting out the power terminals (66). By this arrangement, a more secure and safe submersible pump (10) is provided for utilization.

It will be apparent from the foregoing that while particular forms of the invention have been illustrated and described, various modifications can be made without departing from the spirit and scope of the invention.

What is claimed is:

1. A submersible pump with two levels of moisture sensors comprising a pump housing, a motor secured within the housing, a pair of liquid sensing probes secured within said housing, wherein one of said sensing probes is contained within a chamber of said housing which is located adjacent to or below said motor, and wherein a second sensing probe is located within a chamber of said housing at a position above said motor.

2. The submersible pump of claim 1 further comprising an impeller secured by a shaft to the motor.

3. The submersible pump of claim 1 further comprising electrical power control and sensing cords secured to both the motor and the lower and upper moisture sensing probes.

4. The submersible pump of claim 3 further comprising an electrical terminal located within the chamber of the pump housing located above said motor.

5. The submersible pump of claim 4 wherein the second sensing probe is located at a position lower in the housing than is an electrical terminal.

6. The submersible pump of claim 3 further comprising an alarm system secured to the electrical power control and sensing cords.

* * * * *